US010290949B2

(12) United States Patent
Lam

(10) Patent No.: US 10,290,949 B2
(45) Date of Patent: May 14, 2019

(54) PASSIVELY SWITCHED RESONANT CHAMBER

(71) Applicant: THE BOEING COMPANY, Chicago, IL (US)

(72) Inventor: Tai Anh Lam, Renton, WA (US)

(73) Assignee: The Boeing Company, Chicago, IL (US)

( * ) Notice: Subject to any disclaimer, the term of this patent is extended or adjusted under 35 U.S.C. 154(b) by 56 days.

(21) Appl. No.: 15/698,453

(22) Filed: Sep. 7, 2017

(65) Prior Publication Data

US 2019/0074596 A1 Mar. 7, 2019

(51) Int. Cl.

| | |
|---|---|
| ***H01Q 19/00*** | (2006.01) |
| ***H01P 7/10*** | (2006.01) |
| ***H01P 7/06*** | (2006.01) |

(52) U.S. Cl.

CPC ..... *H01Q 19/00* (2013.01); *H01P 7/06* (2013.01); *H01P 7/10* (2013.01)

(58) Field of Classification Search

CPC ..... H01Q 19/00; H01P 7/06; H01P 7/10
See application file for complete search history.

(56) References Cited

U.S. PATENT DOCUMENTS

| | | | | |
|---|---|---|---|---|
| 8,325,495 | B2 | 12/2012 | Lam et al. | |
| 8,947,892 | B1 | 2/2015 | Lam | |
| 2016/0079019 | A1* | 3/2016 | Borodulin | H01L 45/144 337/396 |
| 2016/0149287 | A1 | 5/2016 | Lam et al. | |
| 2017/0033429 | A1* | 2/2017 | Berdy | H01P 7/06 |

* cited by examiner

*Primary Examiner* — Hoang V Nguyen
(74) *Attorney, Agent, or Firm* — Toler Law Group, PC

(57) ABSTRACT

A passively switched resonant chamber includes one or more conductive walls defining a resonant cavity configured to store energy in an electromagnetic field. The passively switched resonant chamber also includes a switching device that includes a first conductive wire having a first end extending into the resonant cavity. The switching device also includes a second conductive wire having a second end extending into the resonant cavity. The second end is separated from the first end by a gap. A phase change material in the gap is configured to switch from a non-conductive state to a conductive state in response to a strength of the electric field in the resonant cavity satisfying a threshold.

20 Claims, 10 Drawing Sheets

PASSIVELY SWITCHED RESONANT CHAMBER

FIELD OF THE DISCLOSURE

The present disclosure relates to a passively switched resonant chamber.

BACKGROUND

A communication device may include a radio-frequency power amplifier that is coupled to transmission circuitry and to an antenna. The transmission circuitry generates a signal to be transmitted via the antenna, and the radio-frequency power amplifier amplifies the signal prior to transmission. For example, the radio-frequency power amplifier amplifies the signal from a low-power radio-frequency signal to a high-power radio-frequency signal. However, conventional radio-frequency power amplifiers, such as cavity magnetron amplifiers, traveling wave tube amplifiers, or solid-state high-power amplifiers, are heavy and have limited power output.

SUMMARY

According to one implementation, a passively switched resonant chamber includes one or more conductive walls defining a resonant cavity configured to store energy in an electromagnetic field. The passively switched resonant chamber also includes a switching device that includes a first conductive wire having a first end extending into the resonant cavity. The switching device also includes a second conductive wire having a second end extending into the resonant cavity. The second end is separated from the first end by a gap. A phase change material in the gap is configured to switch from a non-conductive state to a conductive state in response to a strength of the electric field in the resonant cavity satisfying a threshold.

According to another implementation, a method includes generating an electric field within a resonant cavity. The resonant cavity is defined by one or more conductive walls coupled to a switching device. The switching device includes a first conductive wire having a first end extending into the resonant cavity and a second conductive wire having a second end extending into the resonant cavity. The second end is separated from the first end by a gap. The method also includes switching a phase change material in the gap from a non-conductive state to a conductive state in response to a strength of the electric field in the resonant cavity satisfying a threshold.

According to another implementation, a system includes a passively switched resonant chamber. The passively switched resonant chamber includes one or more conductive walls defining a resonant cavity configured to store energy in an electromagnetic field. The passively switched resonant chamber also includes a switching device that includes a first conductive wire having a first end extending into the resonant cavity. The switching device also includes a second conductive wire having a second end extending into the resonant cavity. The second end is separated from the first end by a gap. The system also includes a radiating element configured to generate the electric field within the resonant cavity. A phase change material in the gap is configured to switch from a non-conductive state to a conductive state in response to a strength of the electric field in the resonant cavity satisfying a threshold.

Additionally, the features, functions, and advantages that have been described can be achieved independently in various implementations or may be combined in yet other implementations, further details of which are disclosed with reference to the following description and drawings.

DETAILED DESCRIPTION

Figure 1:
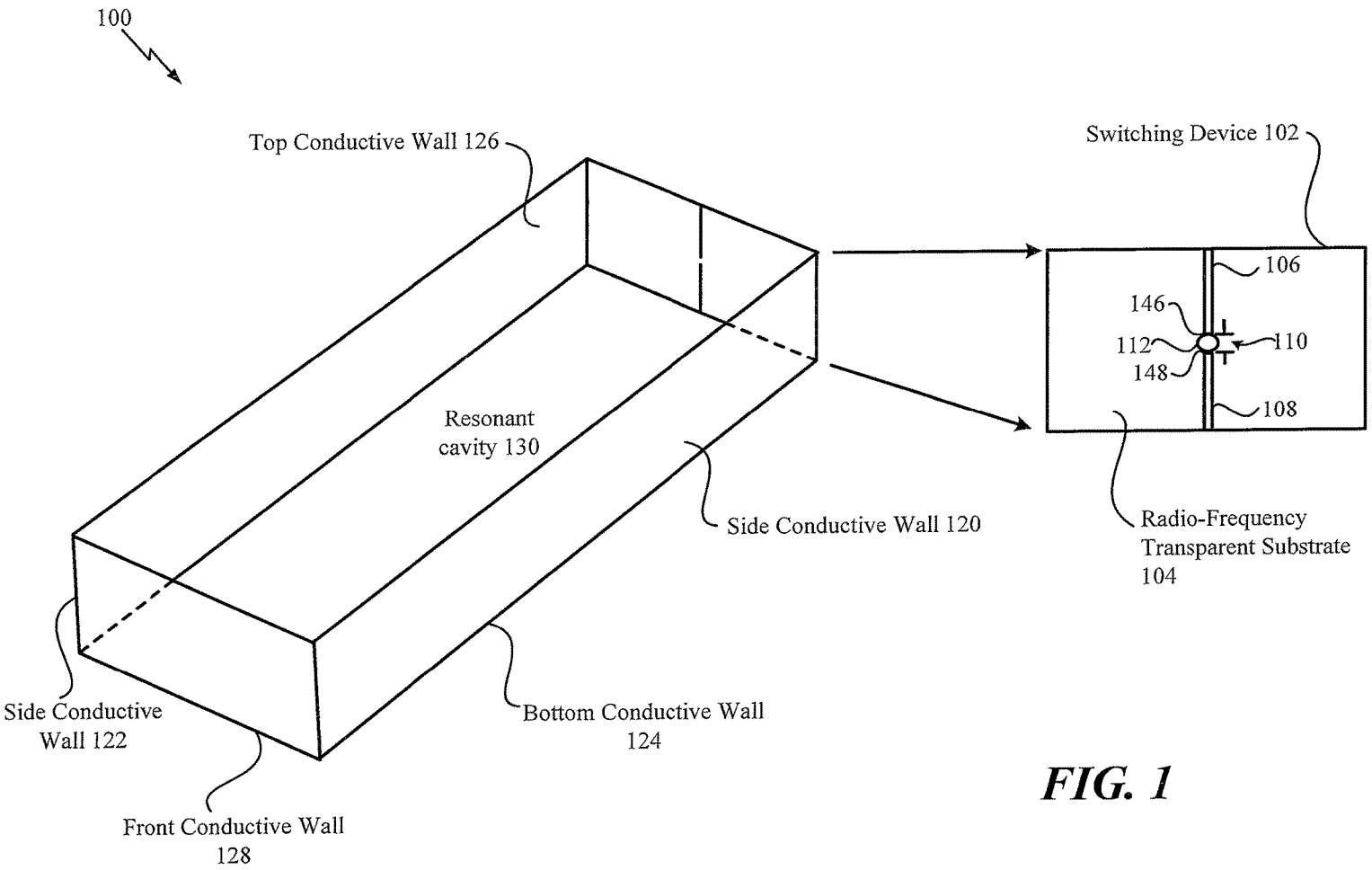
FIG. 1 depicts a passively switched resonant chamber.

Particular embodiments of the present disclosure are described below with reference to the drawings. In the description, common features are designated by common reference numbers throughout the drawings.

The figures and the following description illustrate specific exemplary embodiments. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific embodiments or examples described below, but by the claims and their equivalents.

The present disclosure describes a passively switched resonant chamber that includes one or more conductive walls coupled to a switching device (e.g., a Q-switch). The one or more conductive walls define a resonant cavity that stores energy in an electric field. In a particular implementation, the resonant cavity includes or corresponds to a portion of a waveguide. In such implementations, the passively switched resonant chamber may be used as or referred to as a waveguide amplifier. In the present disclosure, the waveguide is illustrated as a rectangular waveguide which forms an enclosed rectangular resonant cavity; however, it should be understood that the waveguide and the resonant cavity may have other geometrical configurations. For example, the waveguide may be cylindrical, irregular, etc. As another example, the resonant cavity may have a cubic shape, a cylindrical shape, a spherical shape, an irregular shape, or another shape.

The switching device includes two or more conductive wires separated from one another by a gap. In this context, the gap refers to an electrical and/or physical discontinuity between the two or more conductive wires. For example, an end of a first wire may be close to, but separated from, and end of a second wire. A region between the end of the first wire and the second wire may include a phase change material that is configured to transition between a non-conductive state and a conductive state. For example, the phase change material may include a gas that undergoes a phase transition to form a plasma in response to a strong electric field. In this example, the ends of the first and second wire are physically separated from one another, with gas (or plasma) between them. As another example, the phase change material may include a material that undergoes a metal/insulator phase transition in response to a strong electric field. In this example, the phase change material is a solid, and the ends of the first and second wires are each physically coupled to the phase change material. In either of the examples above, the region between the ends of the wires is referred to herein as a "gap" because the region between the ends of the wires is electrically non-conductive except in particular circumstances, as described below.

In some implementations, the conductive wires are embedded in a radio-frequency transparent substrate, such as aluminum nitride or a polymer. In such implementations, the radio-frequency transparent substrate provides structural support for the conductive wires. For example, the radio-frequency transparent substrate may retain the conductive wires in a fixed position to maintain a distance between the conductive wires (i.e., to keep the distance across the gap from changing significantly). In other implementations, the conductive wires are sufficiently rigid that the radio-frequency transparent substrate is omitted. For example, the conductive wires themselves may be rigid, or the conductive wires may be supported along a portion of their length.

Dimensions of the resonant cavity are sized based on a target resonant frequency of the resonant cavity. For example, a distance between a front wall of the resonant cavity is a multiple of a half wavelength of electromagnetic waves having the target resonant frequency. The distance between the ends of the conductive wires is selected to establish a threshold electric field strength for switching the switching device. For example, when the gap is gas filled, the distance between the ends of the conductive wires can be determined based on Paschen's law as a function of a breakdown voltage of the gas and a particular pressure.

When electromagnetic waves are introduced into the resonant cavity (e.g., by a radiating element) and while an electric field strength within the resonant cavity is small, the conductive wires reflect most of the energy of electromagnetic waves having the target resonant frequency. As a result, standing waves at the target resonant frequency are formed in the resonant cavity, enabling energy of the electric field to build up (e.g., be amplified). As more energy is introduced into the resonant cavity, the electric field eventually reaches a threshold magnitude corresponding to a phase transition field strength of the phase change material in the gap. As a result, the phase change material transitions to a conductive state (e.g., a plasma state or a metal state). When the phase change material is in the conductive state, the conductive wires act like a shorted wire across the resonant cavity, which allows electromagnetic energy build up in the resonant cavity to escape. A burst of energy (e.g., electromagnetic waves at the target resonant frequency) is emitted from the resonant cavity, which causes the electric field strength within the resonant cavity to fall below a phase transition threshold of the phase change material. Accordingly, the phase transition material reverts to a non-conductive state (e.g., a gas state or an insulator state), causing the conductive wires to again reflect electromagnetic waves within the resonant chamber. Thus, the switching device passively (e.g., without an external control signal) switches between a transmissive state (e.g., when the phase change material is conductive) and a non-transmissive state (e.g., when the phase change material is non-conductive) to allow energy of an electric field within the resonant cavity to build to a threshold level.

FIG. 1 depicts a passively switched resonant chamber 100. According to one implementation, the passively switched resonant chamber 100 corresponds to or includes a radio-frequency waveguide amplifier that is integrated into or coupled to a communication device. As a non-limiting example, the passively switched resonant chamber 100 may be integrated into or coupled to a communication device as a power amplifier that is operable to amplify a signal that is to be transmitted via a radiating element (e.g., an antenna).

The passively switched resonant chamber 100 includes at least one conductive wall that defines a resonant cavity 130 configured to store energy in an electromagnetic field. For example, in FIG. 1, the passively switched resonant chamber 100 includes a side conductive wall 120, a side conductive wall 122, a bottom conductive wall 124, a top conductive wall 126, and a front conductive wall 128. In the example illustrated in FIG. 1, the conductive walls 120-128 are connected to one another to form a rectangular prism (or box) with one end open. Although five conductive walls 120-128 are illustrated in FIG. 1, in other implementations, the resonant cavity 130 may be defined using fewer than five conductive walls. For example, the resonant cavity 130 may be formed as a cone or horn using a single conductive wall or as a cylindrical using two conductive walls (e.g., one end wall and one cylindrical side wall). Thus, the resonant cavity 130 may include one conductive wall or more than one conductive wall.

The passively switched resonant chamber 100 includes a switching device 102 (e.g., a passive switching device). According to one implementation, the switching device 102 is a Q-switching device. For example, the switching device 102 may generate a pulsed output (e.g., amplified power) based on an electric field build-up within a resonator (e.g., the resonant cavity). In the example illustrated in FIG. 1, the switching device 102 includes a conductive wire 106 (e.g., an electrode) electrically coupled to one of the conductive walls and having an end 146 positioned within the resonant cavity 130. The switching device 102 also includes a conductive wire 108 (e.g., an electrode) electrically coupled to a different one of the conductive walls and having an end 148 positioned within the resonant cavity 130. According to one implementation, the conductive wires 106, 108 are comprised of silver, gold, copper, aluminum, or a combination thereof.

According to one implementation, the conductive wires 106, 108 are embedded in or coupled to a radio-frequency transparent substrate 104. For example, the radio-frequency transparent substrate 104 may be coupled to the conductive walls 120-126, and the conductive wires 106, 108 may be coupled to and supported by the radio-frequency transparent substrate 104. The radio-frequency transparent substrate 104 is a non-conductive substrate. For example, according to one implementation, the radio-frequency transparent substrate 104 includes aluminum nitride, a ceramic, a polymer, or a combination thereof.

The end 148 of the conductive wire 108 is separated from the end 146 of the conductive wire 106 by a gap 110 that includes a phase change material 112. According to one implementation, the phase change material 112 is a solid that undergoes a metal/insulator phase change, such as vanadium (IV) oxide. According to one implementation, the phase change material 112 is a gas that undergoes a phase change to a plasma state. The phase change material 112 is operable to switch between a non-conductive state and a conductive state. According to one implementation, the conductivity of the phase change material 112 is based on the strength of an electric field within the resonator (or within the gap 110). For example, if the strength of the electric field within the resonator fails to satisfy (e.g., is below) an electric field threshold, the phase change material 112 has a non-conductive state. However, if the strength of the electric field within the gap 110 satisfies the electric field threshold, the phase change material 112 switches from the non-conductive state to the conductive state. According to one implementation, the non-conductive state of the phase change material 112 corresponds to a gaseous state, and the conductive state of the phase change material 112 corresponds to a plasma state.

The electric field threshold is based on a phase transition voltage of the phase change material 112. For example, when the phase change material 112 is a gas, the electric field threshold is based on a plasma ignition voltage across the gap 110. The plasma ignition voltage indicates the voltage across the gap 110 that is required to switch the state of the phase change material 112 from the non-conductive state to the conductive state. The plasma ignition voltage is determined based on Paschen's Law. For example, the plasma ignition voltage is a function of the pressure within the gap 110 and a distance across the gap 110. Thus, according to another implementation, the conductivity of the phase change material 112 is based on a voltage (e.g., a direct-current (DC) voltage or a radio-frequency voltage) between the conductive wires 106, 108. For example, the conductive wire 106, the conductive wire 108, or both, may be coupled to a bias voltage source (not shown). In this example, the bias voltage source may generate a voltage difference between the conductive wires 106, 108, which may provide a portion of the phase transition voltage. Thus, in this example, the bias voltage may shift the electric field threshold to increase or decrease a magnitude of energy stored in the electric field needed to initiate the phase change.

As described in further detail with respect to FIGS. 2A-2D, at least a portion of the energy stored in the resonant cavity is released in response to the phase change material 112 switching to the conductive state. For example, at least a portion of the energy associated with the electric field is released as amplified power in response to the phase change material 112 changing from a gaseous state to a plasma state (e.g., in response to plasma ignition).

Figure 2A:
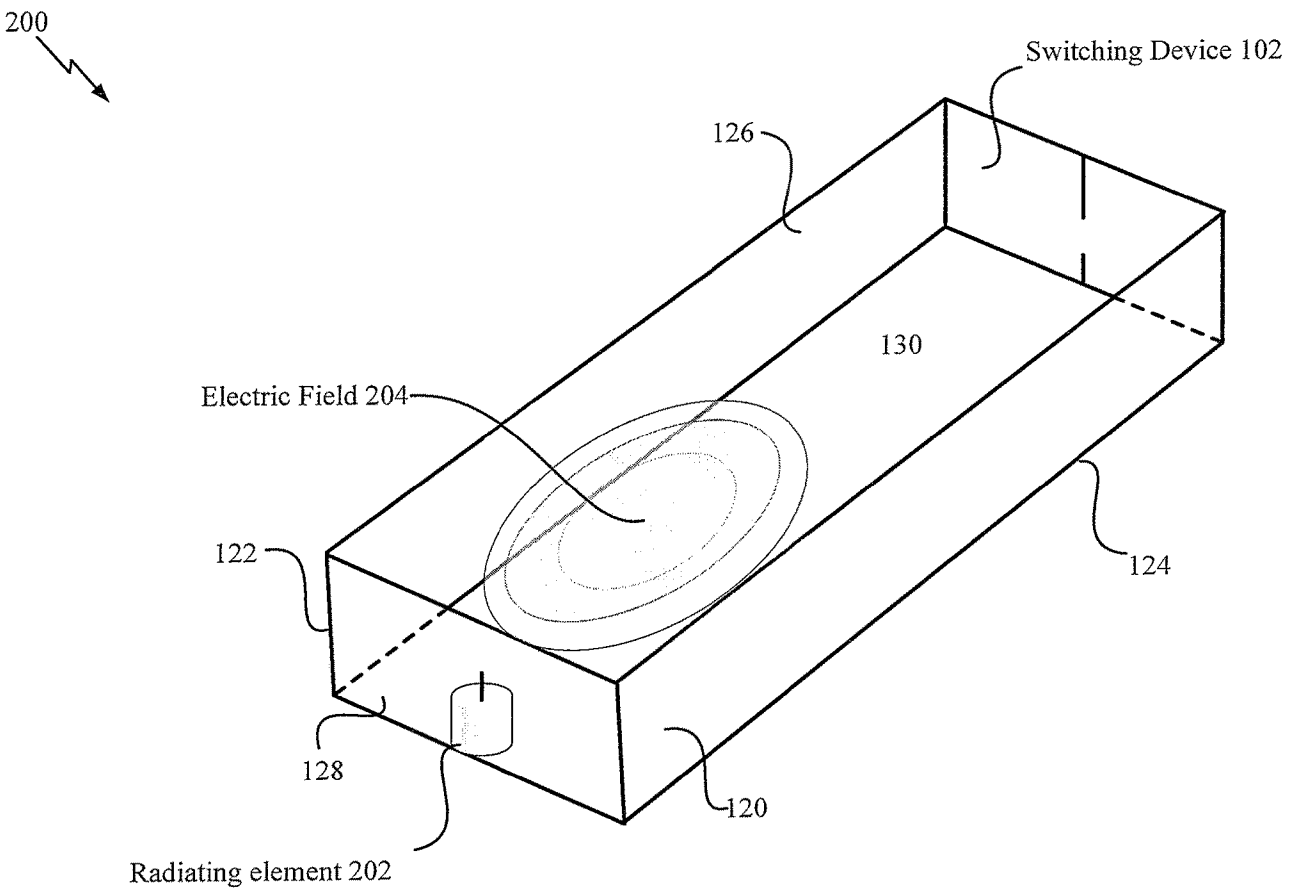
FIG. 2A depicts a first stage of operation of the passively switched resonant chamber of FIG. 1.
Figure 2B:
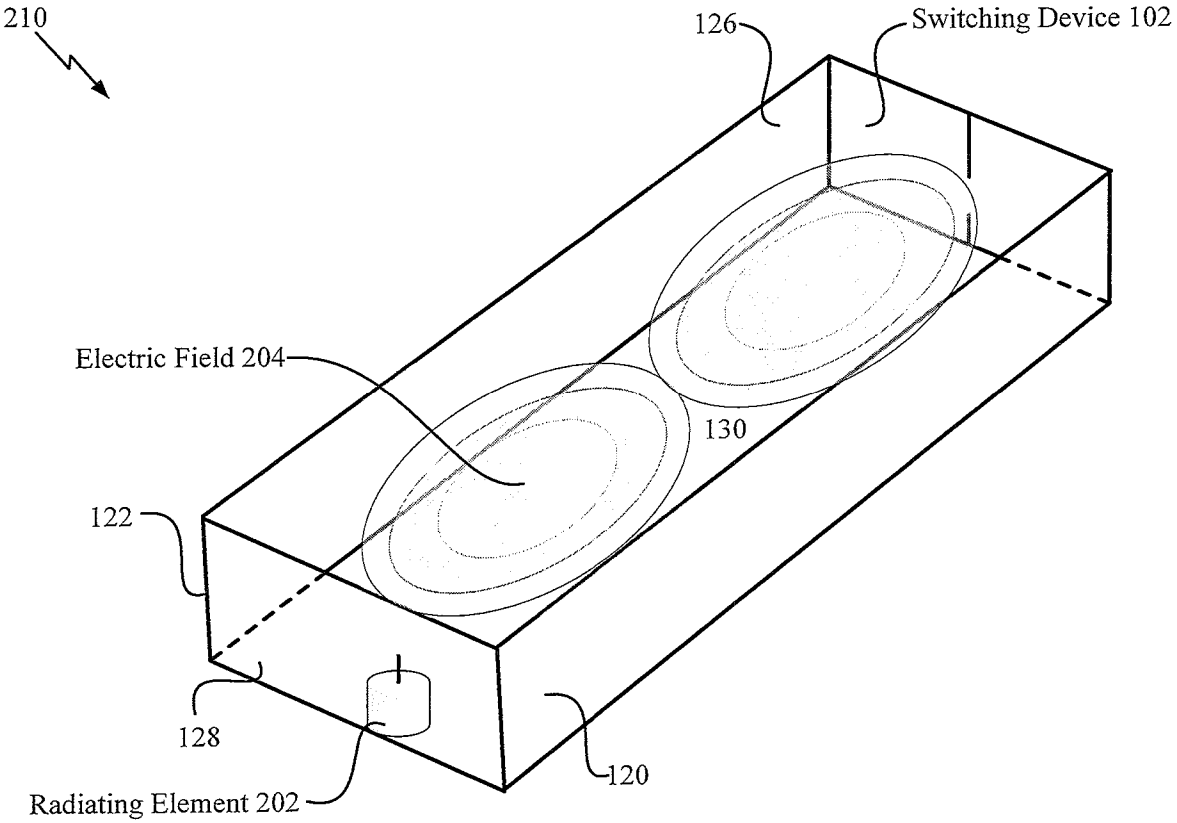
FIG. 2B depicts a second stage of operation of the passively switched resonant chamber of FIG. 1.

Referring to FIG. 2A, an illustrative example of a first stage 200 of operation of the passively switched resonant chamber 100 is shown. During the first stage 200, a radiating element 202 within the passively switched resonant chamber 100 emits electromagnetic energy. In the example illustrated in FIGS. 2A-2D, the radiating element 202 is positioned at an end of the resonant cavity 130 that is opposite to the switching device 102 (e.g., opposite to the radio-frequency transparent substrate 104). However, in other implementations, the radiating element 202 may be positioned at another location within the resonant cavity 130. Also, in other implementations, more than one radiating element 202 may be used.

According to one implementation, the radiating element 202 is a low-power input source. For example, the radiating element 202 may generate a low-power input signal that produces an electric field 204 within the resonator. The electromagnetic energy emitted by the radiating element 202 (or at least a portion of the electromagnetic energy emitted by the radiating element 202) is reflected within the resonant cavity. Thus, over time, the strength (e.g., magnitude) of the electric field 204 increases (due to continuous or occasional input of energy by the radiating element 202 with no corresponding output of energy). For example, in FIG. 2A, the strength (e.g., magnitude) of the electric field 204 is relatively small. However, as illustrated in a second stage 210 of FIG. 2B, the strength of the electric field 204 in the resonant cavity has increased and standing waves at a resonant frequency of the resonant cavity 130 have formed.

Figure 2C:
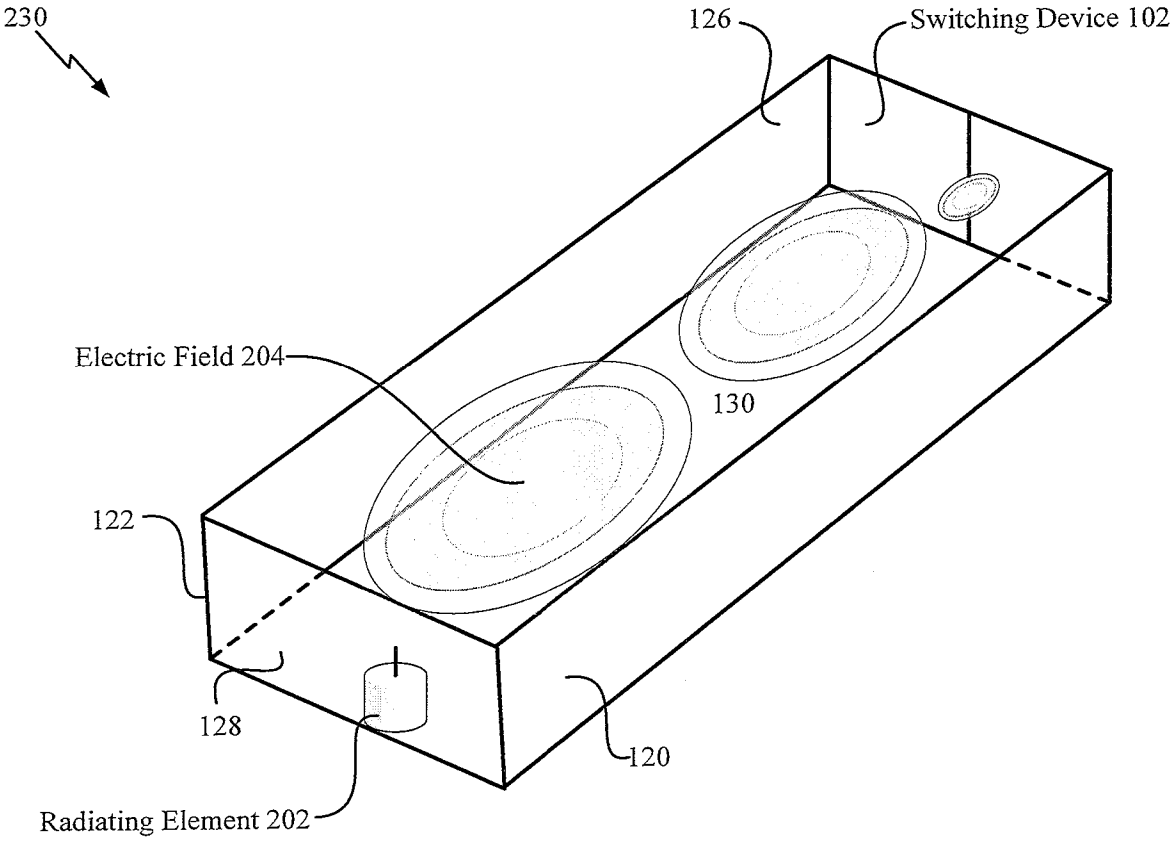
FIG. 2C depicts a third stage of operation of the passively switched resonant chamber of FIG. 1.
Figure 2D:
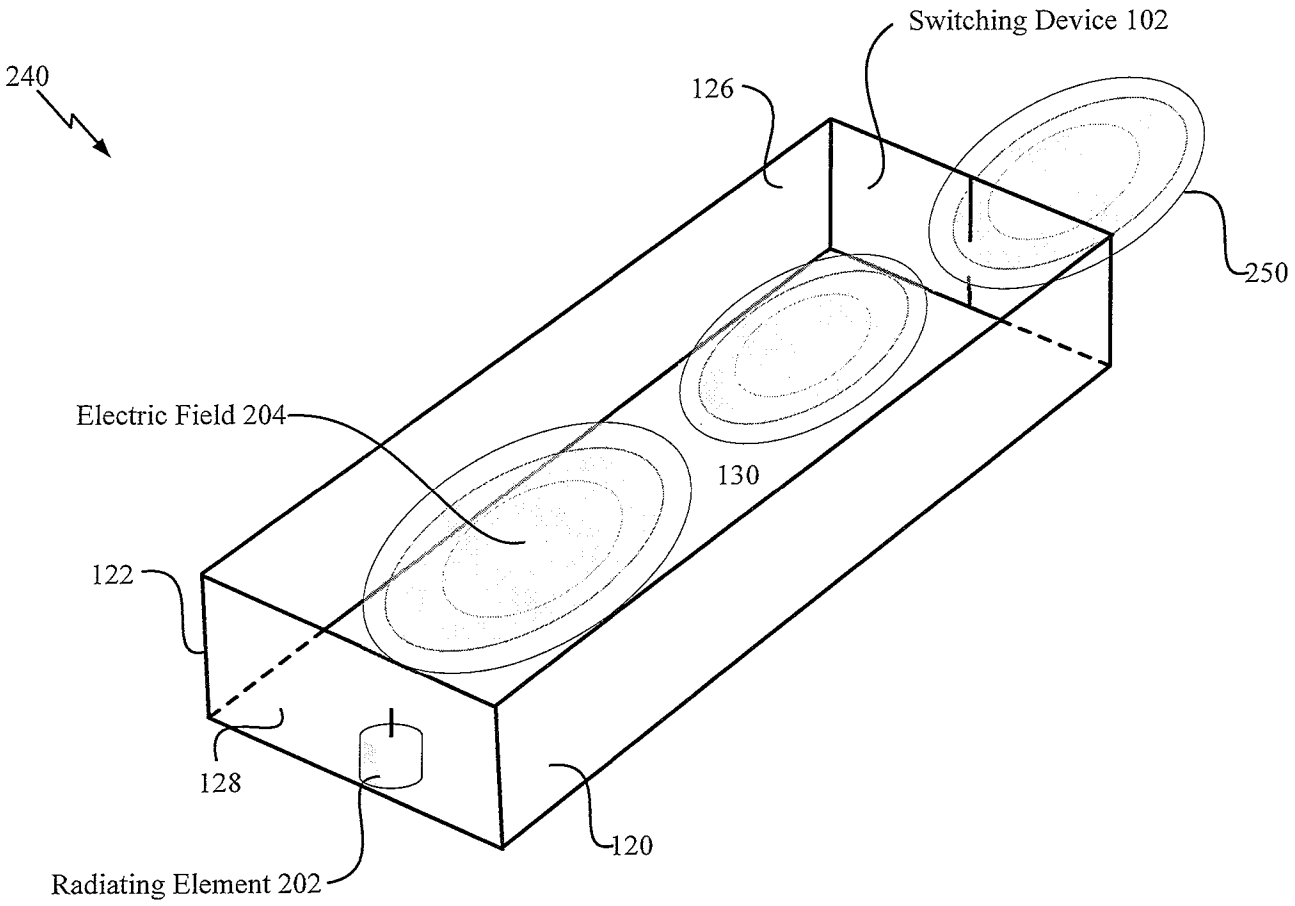
FIG. 2D depicts a fourth stage of operation of the passively switched resonant chamber of FIG. 1.

As illustrated in a third stage 230 of FIG. 2C, the strength of the electric field 204 in the resonant cavity 130 has further increased due to continued emission of electromagnetic energy by the radiating element 202. In response to the strength of the electric field 204 in the resonant cavity 130 increasing such that the strength satisfies (e.g., is greater than) an electric field threshold, the phase change material 112 switches from a non-conductive state to a conductive state. For example, as illustrated in a fourth stage 240 of FIG. 2D, the strength of the electric field 204 in the resonant cavity 130 has satisfied the electric field threshold and the phase change material 112 has switched to the conductive state. As a result, at least a portion of the energy associated with the electric field 204 is released from the resonant cavity 130 as amplified power (e.g., a high-power output). For example, a burst 250 of energy is emitted from the resonant cavity 130, which causes the electric field strength within the resonant cavity 130 to fall below a phase transition threshold of the phase change material 112. Accordingly, the phase change material 112 reverts to a non-conductive state (e.g., a gas state or an insulator state), causing the conductive wires 106, 108 to again reflect electromagnetic waves within the resonant cavity 130. Thus, the switching device 102 passively (e.g., without an external control signal) switches between a transmissive state (e.g., when the phase change material 112 is conductive) and a non-transmissive state (e.g., when the phase change material 112 is non-conductive) to allow energy of the electric field 204 within the resonant cavity 130 to build to a threshold level.

The techniques described with respect to FIGS. 1 and 2A-2D improves power output for power amplifiers. For example, the electric field 204 generated within the resonant cavity 130 of a passively switched resonant chamber 100 may "build" (e.g., increase in strength) and cause the phase change material 112 to switch from the non-conductive state to the conductive state. As a result, energy associated with the electric field 204 is released from the resonant cavity 130 as amplified power (e.g., a higher power output than power output by the radiating element 202). Furthermore, the passively switched resonant chamber 100 is lighter in weight than conventional power amplifiers. As a result, the passively switched resonant chamber 100 is easier to integrate with communication devices than conventional power amplifiers. The passively switched resonant chamber 100 may be used in pulsed radio-frequency systems that require a light-weight and compact radio-frequency or microwave amplifier, such as communication antennas, radars, hand-held through-the-wall radars, unmanned aerial vehicles, etc.

Figure 3:
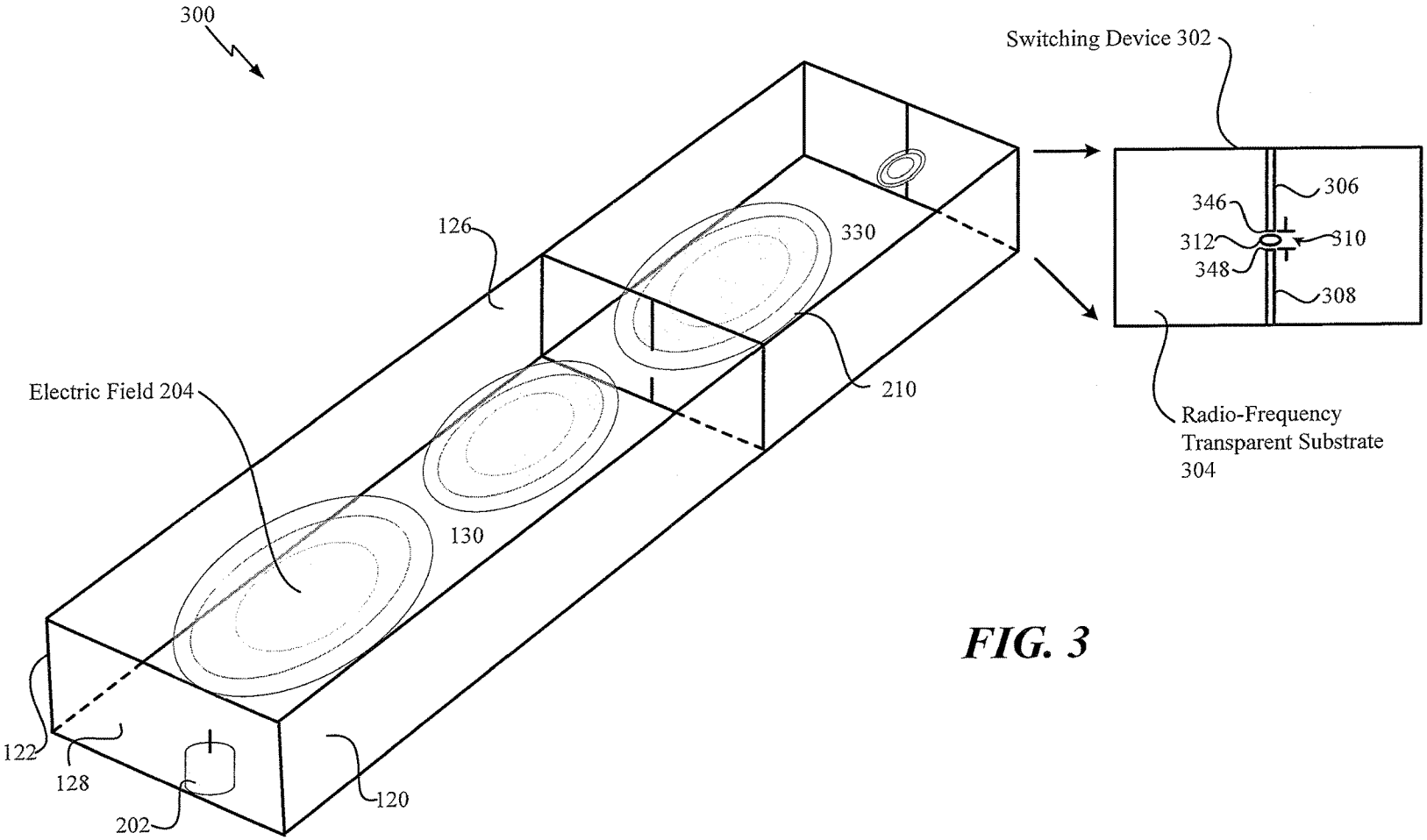
FIG. 3 depicts an example of operation of a cascaded passively switched resonant chamber having multiple resonant cavities.

Referring to FIG. 3, a cascaded passively switched resonant chamber 300 having multiple resonant cavities is shown. The cascaded passively switched resonant chamber 300 includes components of the passively switched resonant chamber 100 and an additional switching device 302 (e.g., a radio-frequency switching device). For example, the conductive walls 120-126 are extended and the switching device 302 is coupled to the extended conductive walls 120-126 to form a second resonant cavity 330.

The switching device 302 includes a conductive wire 306 (e.g., an electrode) electrically coupled to one of the conductive walls and having an end 346 positioned within the second resonant cavity 330. The switching device 302 also includes a conductive wire 308 (e.g., an electrode) electrically coupled to a different one of the conductive walls and having an end 348 positioned within the second resonant cavity 330. According to one implementation, the conductive wires 306, 308 are comprised of silver, gold, copper, aluminum, or a combination thereof.

According to one implementation, the conductive wires 306, 308 are embedded in or coupled to a radio-frequency transparent substrate 304. For example, the radio-frequency transparent substrate 304 may be coupled to the conductive walls 320-326, and the conductive wires 306, 308 may be coupled to and supported by the radio-frequency transparent substrate 304. The radio-frequency transparent substrate 304 is a non-conductive substrate. For example, according to one implementation, the radio-frequency transparent substrate 304 includes aluminum nitride, a ceramic, a polymer, or a combination thereof.

The end 348 of the conductive wire 308 is separated from the end 346 of the conductive wire 306 by a gap 310 that includes a phase change material 312. According to one implementation, the phase change material 312 is a solid that undergoes a metal/insulator phase change, such as vanadium (IV) oxide. According to one implementation, the phase change material 312 is a gas that undergoes a phase change to a plasma state. The phase change material 312 is operable to switch between a non-conductive state and a conductive state. The phase change material 312 may include the same type of material as the phase change material 112 of FIG. 1, or may include a different type of material. For example, the phase change material 112 may include a gas and the phase change material 312 may include a solid. Further, the dimensions of the gap 310 may be the same as the dimensions of the gap 110, or the dimensions of the gap 310 may be different from the dimensions of the gap 110.

The switching device 302 may operate in a substantially similar manner as the switching device 102. In response to the phase change material 112 switching to the conductive state, at least a portion of the energy associated with the electric field 204 (e.g., the burst 250) may be released into the second resonant cavity 330. Releasing multiple bursts of energy from the resonant cavity 130 into the second resonant cavity 330 causes the electric field within the second resonant cavity 330 to increase in strength. When an electric field in the gap 310 satisfies (e.g., is greater than or equal to) a second electric field threshold, the phase change material 312 switches from a non-conductive state to a conductive state. As a result, at least a portion of the energy associated with the electric field in the second resonant cavity 330 is released from the second resonant cavity 330 as amplified power.

The cascaded passively switched resonant chamber 300 of FIG. 3 may enable increased amplification levels compared to the passively switched resonant chamber 100 of FIG. 1. For example, an electric field having a greater amount of energy may be stored in the cascaded passively switched resonant chamber 300 than in the passively switched resonant chamber 100. As a result, in response to the phase change material 312 switching to the conductive state, an increased amount of amplified power is released from the cascaded passively switched resonant chamber 300.

Figure 4:
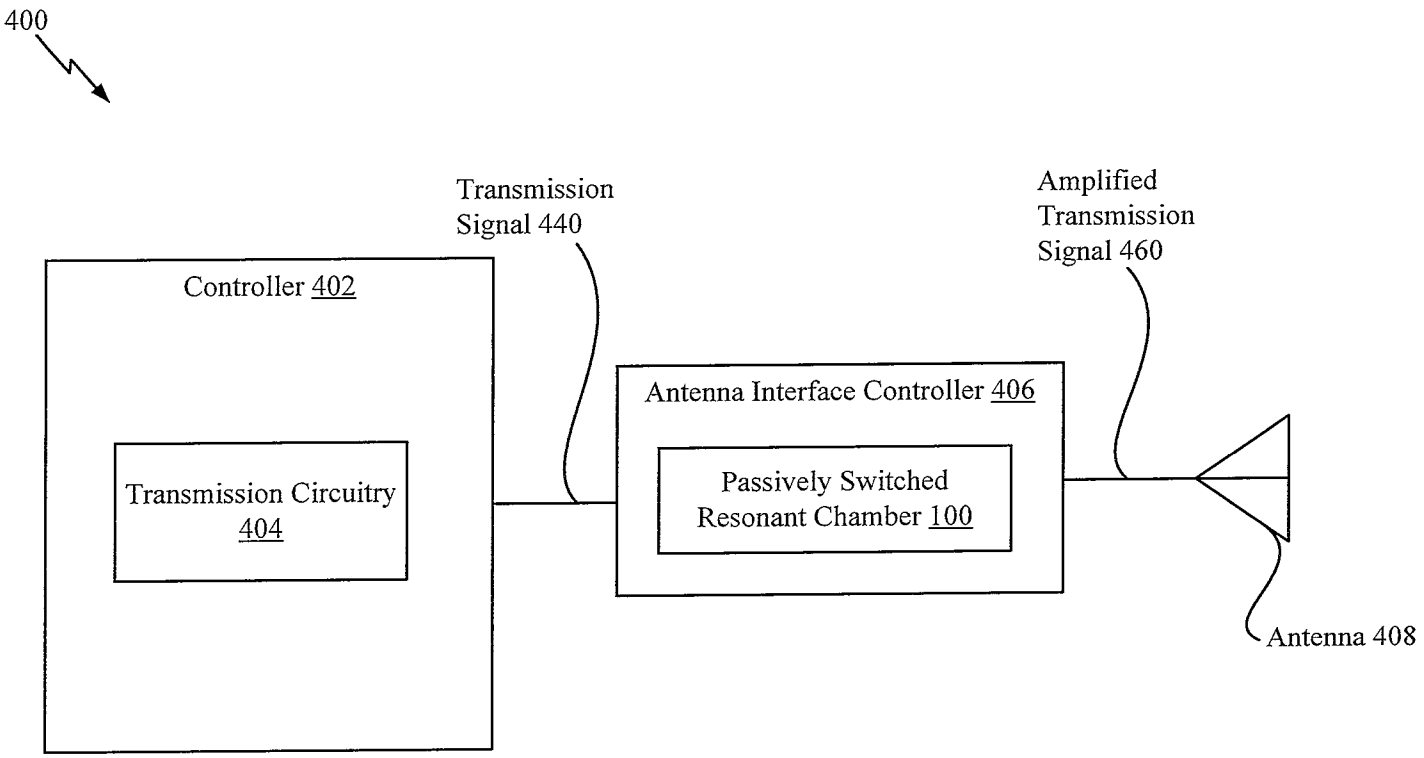
FIG. 4 depicts a system that includes the passively switched resonant chamber of FIG. 1.

Referring to FIG. 4, a diagram of a system 400 that is operable to amplify a transmission signal using a passively switched resonant chamber is shown. The system 400 includes a controller 402, an antenna interface controller 406, and an antenna 408. The controller 402 includes transmission circuitry 404. The antenna interface controller 406 includes the passively switched resonant chamber 100. According to one implementation, the system 400 may be integrated into an airplane, a ship, a mobile device, a car, etc.

During operation, the transmission circuitry 404 may generate a transmission signal 440 that is to be transmitted by the antenna 408. The transmission circuitry 404 provides the transmission signal 440 to the antenna interface controller 406.

The radiating element 202 of FIG. 2 may generate a low-power input signal that produces the electric field 204 within the resonant cavity 130 of the passively switched resonant chamber 100. The electric field 204 increases in field strength as the electromagnetic waves are reflect within the resonant cavity 130 and as additional power is introduced by the radiating element 202. In response to the electric field 204 satisfying the electric field threshold, the phase change material 112 switches from a non-conductive state to a conductive state. As a result, at least a portion of the energy associated with the electric field 204 is released from the resonant cavity 130 as an amplified transmission signal 460 (e.g., a high-power output). The amplified transmission signal 460 is transmitted by the antenna 408.

The system 400 of FIG. 4 improves power output for power amplifiers. For example, the passively switched resonant chamber 100 is used (as a power amplifier) to amplify the transmission signal 440. The electric field 204 generated within the resonant cavity of a passively switched resonant chamber 100 may "build" (e.g., increase in strength) and cause the phase change material 112 to switch from the non-conductive state to the conductive state. As a result, energy associated with the electric field 204 is released from the resonant cavity as amplified power (e.g., a higher power output than power outputs associated with conventional power amplifiers). The amplified power amplifies the transmission signal 440 to generate the amplified transmission signal 460.

Figure 5:
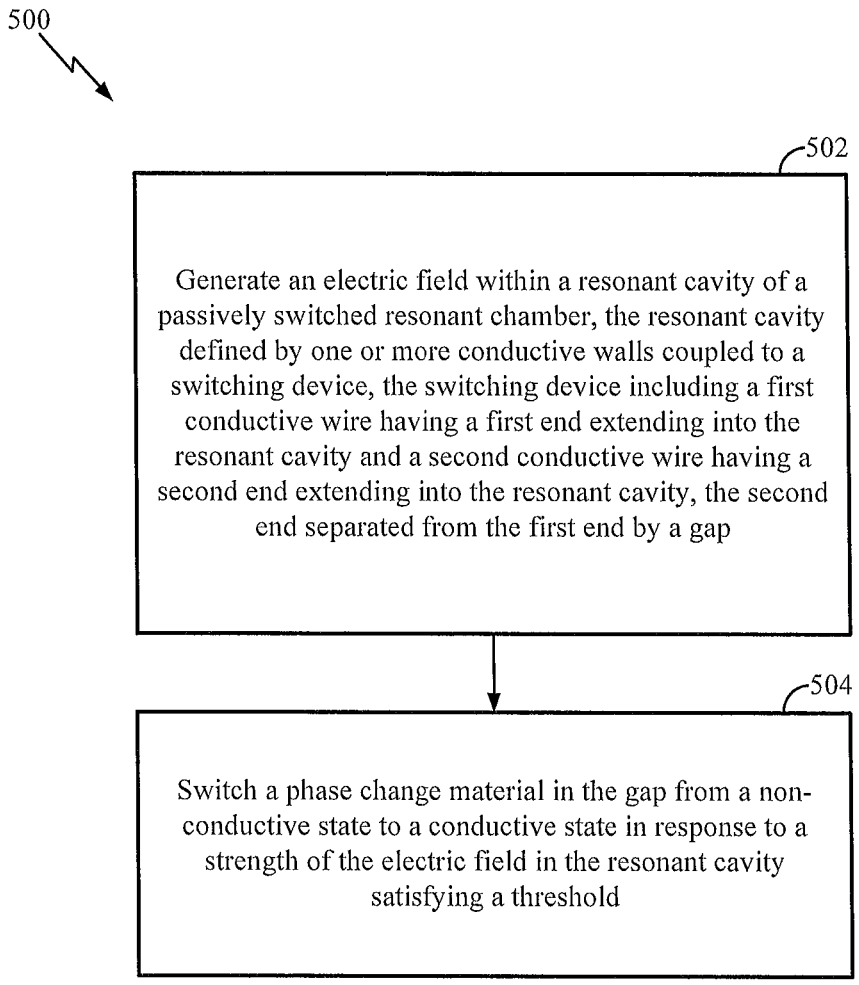
FIG. 5 depicts a flowchart illustrating operation of the passively switched resonant chamber of FIG. 1.

Referring to FIG. 5, a method 500 for performing a switching operation using a passively switched resonant chamber is shown. The method 500 is performed by the passively switched resonant chamber 100 of FIG. 1.

The method 500 includes generating an electric field within a resonant cavity of a passively switched resonant chamber, at 502. For example, referring to FIGS. 2A-2D, the radiating element 202 generates the electric field 204 within the resonant cavity 130 of the passively switched resonant chamber 100. The resonant cavity 130 is defined by one or more conductive walls 120-128 coupled to the switching device 102. The switching device 102 includes the first conductive wire 106 having the first end 146 extending into the resonant cavity 130 and the second conductive wire 108 having the second end 148 extending into the resonant cavity 130. The second end 148 is separated from the first end 146 by the gap 110.

The method 500 also includes switching a phase change material in the gap from a non-conductive state to a conductive state in response to a strength of the electric field in the resonant cavity satisfying a threshold, at 504. For example, referring to FIG. 2D, the switching device 102 switches the phase change material 112 from the non-conductive state to the conductive state in response to the strength of the electric field 204 in the gap 110 satisfying the electric field threshold. As a result, at least a portion of the energy associated with the electric field 204 is released from the resonant cavity 130 as amplified power (e.g., a high-power output).

The method 500 of FIG. 5 improves power output for power amplifiers. For example, the electric field 204 generated within the resonant cavity of a passively switched resonant chamber 100 may "build" (e.g., increase in strength) and cause the phase change material 112 to switch from the non-conductive state to the conductive state. As a result, energy associated with the electric field 204 is released from the resonant cavity as amplified power (e.g., a higher power output than power outputs associated with conventional power amplifiers). Furthermore, the passively switched resonant chamber 100 is lighter in weight than conventional power amplifiers. As a result, the passively switched resonant chamber 100 is easier to integrate with communication devices than conventional power amplifiers.

Figure 6:
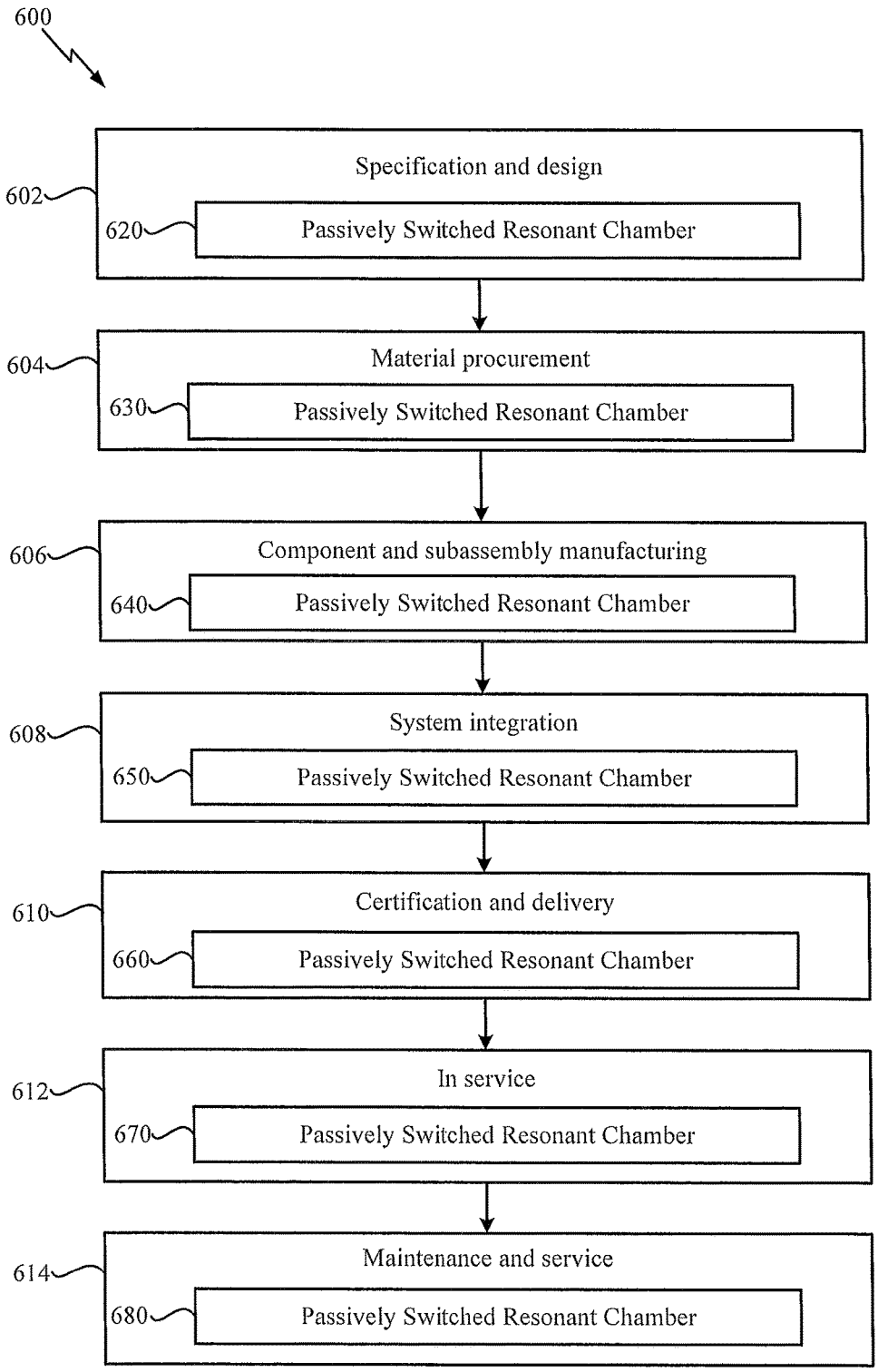
FIG. 6 depicts a flowchart illustrative of a life cycle of an aircraft that includes the passively switched resonant chamber of FIG. 1.

Referring to FIG. 6, a flowchart illustrative of a life cycle of an aircraft that includes a passively switched resonant chamber is shown and designated 600. During pre-production, the exemplary method 600 includes, at 602, specification and design of an aircraft, such as the aircraft 702 described with reference to FIG. 7. During specification and design of the aircraft, the method 600 may include, at 620, specification and design of a passively switched resonant chamber including a radio-frequency switching device. For example, the radio-frequency switching device may include the switching device 102 of FIG. 1 or the radio-frequency switching device 302 of FIG. 3. The passively switched resonant chamber may correspond to the passively switched resonant chamber 100 of FIG. 1. At 604, the method 600 includes material procurement. At 630, the method 600 includes procuring materials (e.g., phase change material) for the passively switched resonant chamber, such as materials for the radio-frequency switching device.

During production, the method 600 includes, at 606, component and subassembly manufacturing and, at 608, system integration of the aircraft. For example, the method 600 may include, at 640, component and subassembly manufacturing (e.g., producing the radio-frequency switching device) of the passively switched resonant chamber and, at 650, system integration (e.g., coupling the passively switched resonant chamber to one or more RF circuits, antenna interfaces, or bias signal controllers) of a communications system. At 610, the method 600 includes certification and delivery of the aircraft and, at 612, placing the aircraft in service. Certification and delivery may include, at 660, certifying the passively switched resonant chamber. At 670, the method 600 includes placing the aircraft including the passively switched resonant chamber in service. While in service by a customer, the aircraft may be scheduled for routine maintenance and service (which may also include modification, reconfiguration, refurbishment, and so on). At 614, the method 600 includes performing maintenance and service on the aircraft. At 680, the method 600 includes performing maintenance and service of the passively switched resonant chamber. For example, maintenance and service of the passively switched resonant chamber may include replacing one or more of the radio-frequency switching devices.

Each of the processes of the method 600 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

Figure 7:
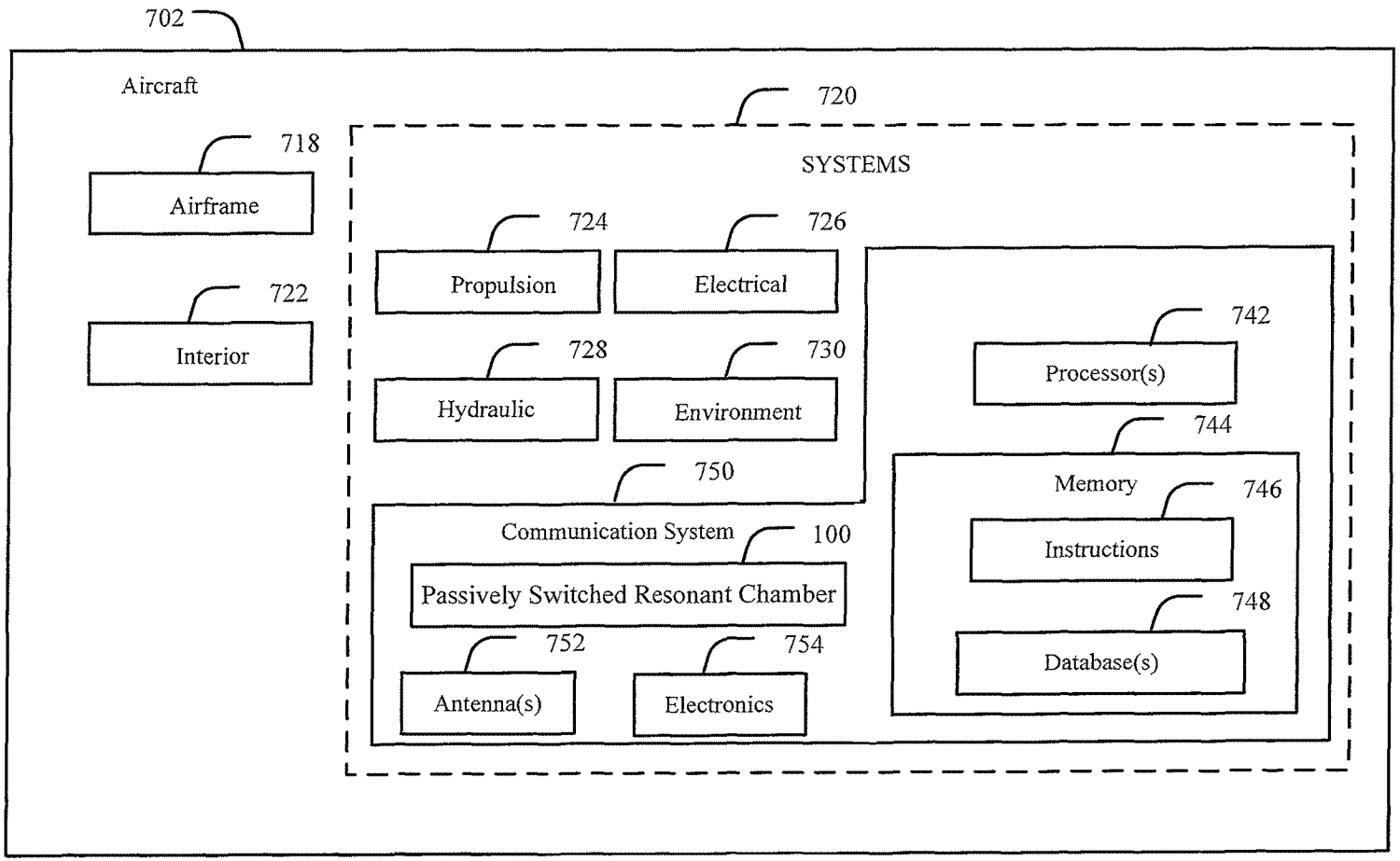
FIG. 7 depicts an aircraft that includes the passively switched resonant chamber of FIG. 1.

Referring to FIG. 7, a block diagram of an aircraft that includes a radio-frequency passively switched resonant chamber is shown and designated 702. As shown in FIG. 7, the aircraft 702 produced by the method 600 may include an airframe 718 with a plurality of systems 720 and an interior 722. Examples of high-level systems 720 include one or more of a propulsion system 724, an electrical system 726, a hydraulic system 728, an enviromnental system 730, and a communications system 750. The communications system 750 includes one or more processors 742, a memory 744, one or more antennas 752, electronics 754, and the passively switched resonant chamber 100. The memory 744 may include instructions 746 and a database(s) 748.

Apparatus and methods embodied herein may be employed during any one or more of the stages of the method 600. For example, components or subassemblies corresponding to production process 608 may be fabricated or manufactured in a manner similar to components or subassemblies produced while the aircraft 702 is in service, at 612 for example and without limitation. Also, one or more apparatus embodiments, method embodiments, or a combination thereof may be utilized during the production stages (e.g., elements 602-610 of the method 600), for example, by substantially expediting assembly of or reducing the cost of the aircraft 702. Similarly, one or more of apparatus embodiments, method embodiments, or a combination thereof may be utilized while the aircraft 702 is in service, at 612 for example and without limitation, to maintenance and service, at 614.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Further, although a particular implementation that includes the passively switched resonant chamber 100 in an aircraft communication system 750 has been illustrated, the passively switched resonant chamber 100 may be used in other aircraft subsystems, such as in an electronic warfare or electronic countermeasures system. Further, the passively switched resonant chamber 100 is not limited to uses related to aircraft. For example, the passively switched resonant chamber 100 may be used as a power amplifier in any fixed location or portable radiofrequency or microwave system. Accordingly, the disclosure and the figures are to be regarded as illustrative rather than restrictive.

The steps of a method or algorithm described in connection with the implementations disclosed herein may be included directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal. A storage device is not a signal.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate but do not limit the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. A passively switched resonant chamber comprising:
one or more conductive walls defining a resonant cavity configured to store energy in an electromagnetic field; and
a switching device comprising:
a first conductive wire having a first end extending into the resonant cavity;
a second conductive wire having a second end extending into the resonant cavity, the second end separated from the first end by a gap; and
a phase change material in the gap, the phase change material configured to switch from a non-conductive state to a conductive state in response to a strength of the electric field in the resonant cavity satisfying a threshold.

2. The passively switched resonant chamber of claim 1, wherein at least a portion of the energy stored in the resonant cavity is released in response to the phase change material switching to the conductive state.

3. The passively switched resonant chamber of claim 1, further comprising a radio-frequency transparent substrate coupled to the one or more conductive walls, wherein the first conductive wire and the second conductive wire are coupled to the radio-frequency transparent substrate.

4. The passively switched resonant chamber of claim 3, wherein the phase change material is coupled to the radio-frequency transparent substrate.

5. The passively switched resonant chamber of claim 3, the radio-frequency transparent substrate comprises aluminum nitride.

6. The passively switched resonant chamber of claim 1, wherein the phase change material comprises vanadium (IV) oxide.

7. The passively switched resonant chamber of claim 1, wherein the non-conductive state of the phase change material corresponds to a gaseous state, and wherein the conductive state of the phase change material corresponds to a plasma state.

8. A method comprising:
generating an electric field within a resonant cavity of a passively switched resonant chamber, the resonant cavity defined by one or more conductive walls coupled to a switching device, the switching device comprising:
a first conductive wire having a first end extending into the resonant cavity; and
a second conductive wire having a second end extending into the resonant cavity, the second end separated from the first end by a gap; and
switching a phase change material in the gap from a non-conductive state to a conductive state in response to a strength of the electric field in the resonant cavity satisfying a threshold.

9. The method of claim 8, wherein at least a portion of energy stored in the resonant cavity is released in response to the phase change material switching to the conductive state.

10. The method of claim 8, wherein the switching device further comprises a radio-frequency transparent substrate coupled to the one or more conductive walls, wherein the first conductive wire and the second conductive wire are coupled to the radio-frequency transparent substrate.

11. The method of claim 8, wherein the switching device is a Q-switching device.

12. The method of claim 8, wherein the non-conductive state of the phase change material corresponds to a gaseous state, and wherein the conductive state of the phase change material corresponds to a plasma state.

13. A system comprising:
a passively switched resonant chamber comprising:
one or more conductive walls defining a resonant cavity configured to store energy in an electromagnetic field; and
a switching device comprising:
a first conductive wire having a first end extending into the resonant cavity;
a second conductive wire having a second end extending into the resonant cavity, the second end separated from the first end by a gap; and
a phase change material in the gap, the phase change material configured to switch from a non-conductive state to a conductive state in response to a strength of the electric field in the resonant cavity satisfying a threshold; and
a radiating element configured to generate the electric field within the resonant cavity.

14. The system of claim 13, wherein at least a portion of the energy stored in the resonant cavity is released in response to the phase change material switching to the conductive state.

15. The system of claim 13, wherein the radiating element is positioned at an end of the passively switched resonant chamber that is opposite to the switching device.

16. The system of claim 13, further comprising:

a second switching device comprising:

a third conductive wire having a third end extending into a second resonant cavity defined by additional conductive walls that are coupled to the one or more conductive walls, the second resonant cavity configured to store energy released from the resonant cavity;

a fourth conductive wire having a fourth end extending into the second resonant cavity, the fourth end separated from the third end by a second gap; and a second phase change material in the second gap, the second phase change material configured to switch from a non-conductive state to a conductive state in response to a strength of a second electric field in the second resonant cavity satisfying a second threshold.

17. The system of claim 16, wherein the second electric field propagates to the second resonant cavity in response to the phase change material switching to the conductive state.

18. The system of claim 16, wherein at least a portion of energy associated with second electric field is released from the second resonant cavity in response to the second phase change material switching to the conductive state.

19. The system of claim 16, further comprising a second radio-frequency transparent substrate coupled to the one or more conductive walls, wherein the third conductive wire and the fourth conductive wire are coupled to the second radio-frequency transparent substrate.

20. The system of claim 13, wherein the first conductive wire and the second conductive wire are comprised of silver, gold, copper, aluminum, or a combination thereof.

* * * * *